United States Patent [19]

Butkus et al.

[11] Patent Number: 4,951,823

[45] Date of Patent: Aug. 28, 1990

[54] PAPERBOARD LOAD BLOCK

[75] Inventors: Robert A. Butkus, Oakland; Robert C. Olsen, Cupertino; William K. Sambrailo, Watsonville, both of Calif.

[73] Assignee: Container Corporation of America, Clayton, Mo.

[21] Appl. No.: 437,348

[22] Filed: Nov. 16, 1989

[51] Int. Cl.[5] ..... B65D 81/04

[52] U.S. Cl. ..... 206/586; 229/93; 229/DIG. 1

[58] Field of Search ..... 206/586, 453, 591, 320; 229/DIG. 1, 93

[56] References Cited

U.S. PATENT DOCUMENTS

| | | | |
|---|---|---|---|
| 1,601,957 | 10/1926 | Gaylord | 206/586 |
| 1,821,692 | 9/1931 | Copeland | 206/586 |
| 2,507,929 | 5/1950 | Pennebaker | 206/586 |
| 2,609,136 | 9/1952 | Sider | 206/586 X |
| 2,684,153 | 7/1954 | Freiberg | 206/453 X |
| 2,861,681 | 11/1958 | Lane | 206/586 X |
| 2,896,832 | 7/1959 | Lane | 206/586 |
| 3,043,488 | 7/1962 | Warwick | 206/586 X |
| 3,086,689 | 4/1963 | Wiedermeier | 206/586 X |
| 3,119,542 | 1/1964 | Pomerantz | 206/586 |
| 3,199,765 | 8/1965 | Locke | 229/93 |
| 3,708,101 | 1/1973 | McPanreld | 206/591 X |
| 3,767,066 | 10/1973 | Martin et al. | 410/118 |
| 3,957,196 | 5/1976 | Kellerman | 206/521 X |
| 3,982,682 | 9/1976 | Fremion | 206/586 |
| 4,248,350 | 2/1981 | Gilbert | 206/586 |
| 4,880,944 | 11/1989 | Kanaljuk et al. | 229/93 X |

FOREIGN PATENT DOCUMENTS

| | | | |
|---|---|---|---|
| 3303180 | 8/1984 | Fed. Rep. of Germany | 206/586 |

*Primary Examiner*—Bryon P. Gehman

*Attorney, Agent, or Firm*—Richard W. Carpenter

[57] ABSTRACT

A collapsible, self-locking load block of the type used as dunnage to prevent cargo from shifting in a truck or rail car body. The load block is formed from a one-piece blank of foldable sheet material, such as paperboard, and includes opposed pairs of side walls joined to form an open-ended, tubular structure that is generally rectangular in cross-section with its width, length, and height of different dimensions. The load block also includes internal center panels extending diagonally between opposite corners of the tubular structure.

17 Claims, 2 Drawing Sheets

PAPERBOARD LOAD BLOCK

BACKGROUND OF THE INVENTION

1. Field of the Invention

This invention relates to load blocks of the type used as a form of dunnage to prevent cargo from shifting in a truck or rail car, and more particularly to a collapsible, self-locking load block made from a one-piece blank of foldable sheet material such as paperboard.

2. Description of the Background Art

A background art search directed to the subject matter of the present invention conducted in the United States Patent and Trademark Office disclosed the following United States Letters Patent:

| | | | |
|---|---|---|---|
| 1,108,045 | 1,997,905 | 2,507,929 | 2,609,136 |
| 2,684,153 | 3,043,488 | 3,708,101 | 3,767,066 |
| 3,842,757 | 3,985,242 | 4,148,396 | 4,248,350 |

None of the patents found in the search discloses a collapsible, one-piece, self-locking load block, with different length, width, and height dimensions, that includes opposed pairs of walls forming a tubular structure, with a pair of interlocking internal center panels extending diagonally between opposed corners of the tubular structure, and that also includes openings adapted for insertion of a retaining member into the block to assist in maintaining the load block in different positions adjacent the cargo in a transportation vehicle.

SUMMARY OF THE INVENTION

It is an object of the present invention to provide a collapsible, self-locking load block of the type used for dunnage that is formed from a one-piece blank of foldable sheet material, such as paperboard, and that can be easily and quickly erected for use to space and stabilize cargo in a transportation vehicle.

Another object of the invention is to provide a paperboard load block having different length, width, and height dimensions and having openings in different places adapted to receive an end of a retaining member to assist in positioning the load block relative to the location of the cargo.

A more specific object of the invention is to provide a strong rigid load block having opposed pairs of side panels interconnected to form a tubular structure with a pair of internal center panels interlocked in face-to-face relation extending diagonally between opposed corners of the structure.

These and other objects of the invention will be apparent from an examination of the following description and drawings.

It will be understood that, for purposes of clarity, certain elements may have been intentionally omitted from certain views where thay are believed to be illustrated to better advantage in other views.

DESCRIPTION OF THE PREFERRED EMBODIMENT

Figure 1:
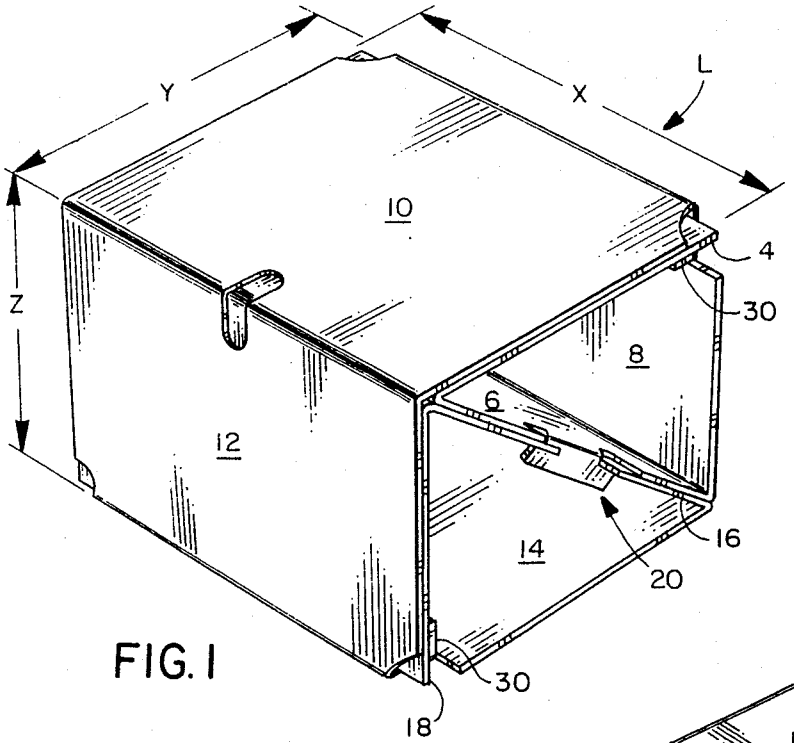
FIG. 1 is an isometric view of a paperboard load block embodying features of the present invention.
Figure 2:
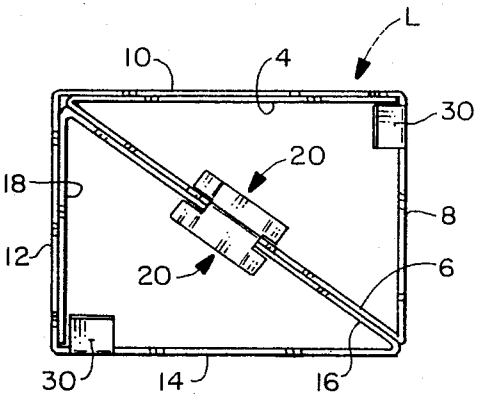
FIG. 2 is an end elevational view of the structure illustrated in FIG. 1.
Figure 7:
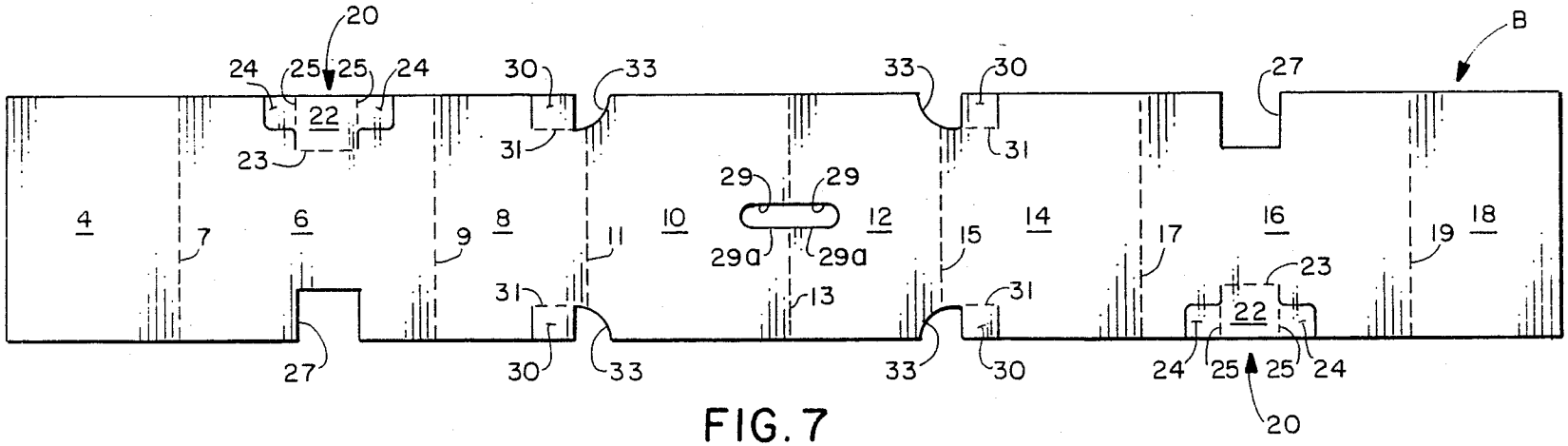
FIG. 7 is a plan view of a blank of foldable sheet material from which the load block illustrated in the other views can be formed.

Referring now to the drawings for a better understanding of the invention, it will be seen that the load block indicated generally at L in FIG. 1 of the drawings may be formed from the one-piece blank B of foldable sheet material, such as paperboard or plastic material, illustrated in FIG. 7.

Blank B is cut and scored to provide the following panels which are serially arranged in the following sequence from left to right in FIG. 7: first side wall inner panel 4, first center panel 6, fourth side wall panel 8, first side wall outer panel 10, second side wall outer panel 12, third side wall panel 14, second center panel 16, and second side wall inner panel 18; and which are foldably joined to each other along parallel fold lines 7, 9, 11, 13, 15, 17, and 19, respectively.

Figure 8:
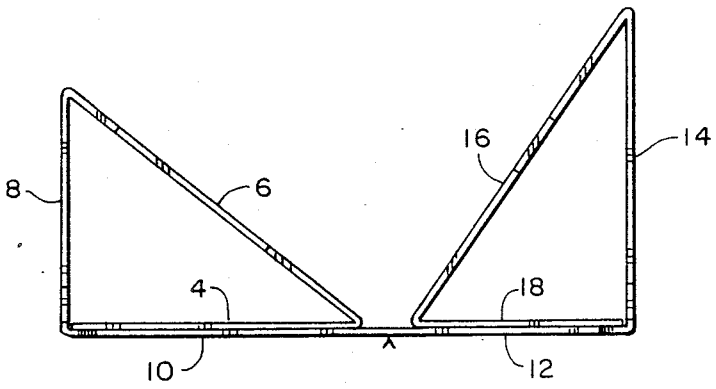
FIG. 8 is a fragmentary end elevational view illustrating one step in the erection of the load block shown in FIG. 1 from the from the blank shown in FIG. 7.

In order to erect the blank of FIG. 7 into the load block of FIG. 1, the blank B is first folded as shown in FIG. 8, with the inner and outer panels of the first and second side walls disposed against each other whereby two triangular tubular structures are formed. Then the two center panels are brought together in face-to-face relation and secured together in a manner hereinafter described to form the complete load block L which is generally rectangular in cross-section.

As best seen in FIG. 7, each of the center panels has at one end a lock tab 20 and at the other end thereof a recess 27. The lock tab 20 of each center panel is adapted to be received within the complementary recess 27 at the corresponding end of the other center panel, as shown in FIGS. 1–5.

Each lock tab 20 is formed from material of its center panel and is generally T-shaped. The tab includes a main portion 22, foldably joined to the center panel on a fold line 23, and a pair of side portions or wings 24, foldably joined to opposed sides of the main portion on fold lines 25. The wings are adapted to be folded out of the plane of the main portion temporarily, so the lock tab can be inserted into the recess of the other center panel to provide interlocking engagement between the center panels.

Again referring to FIG. 1, it can be seen that first and second side wall outer panels 10 and 12, respectively, have adjacent cutouts or openings **29*a* which form a common opening 29 that extends around a corner of the load block, as seen in FIG. 1** of the drawings. The purpose of the opening is to permit insertion of an end of a retaining member or skewer S in order to help maintain the load block in a position where it can help prevent cargo from shifting in a transportation vehicle such as a truck or rail car.

Figure 6:
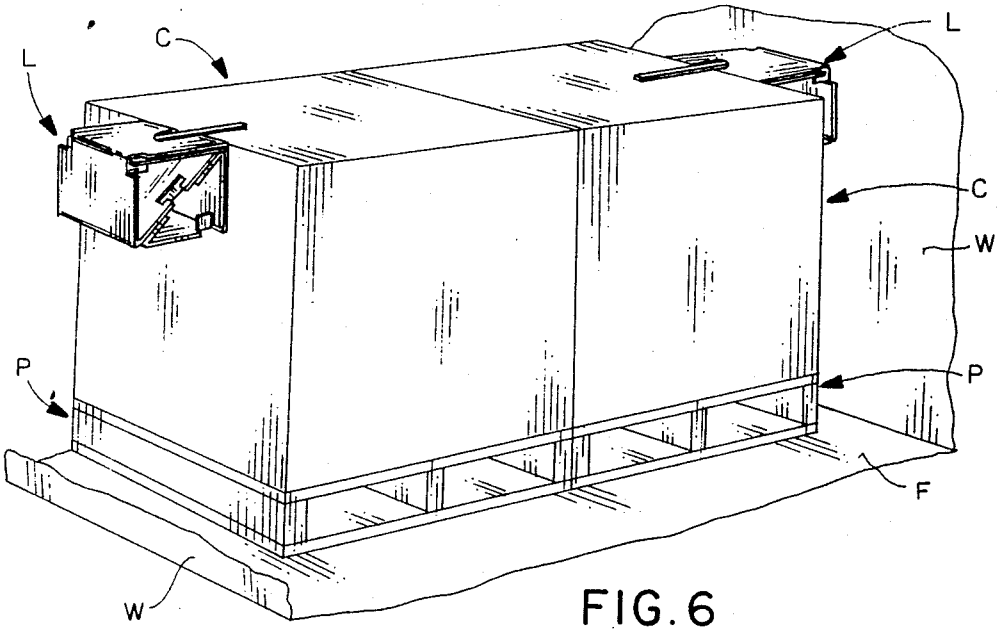
FIG. 6 is a fragmentary isometric view illustrating the manner in which the load block of the present invention is utilized to stabilize cargo in a transportation vehicle.

For example, in FIG. 6 a typical loading arrangement is illustrated. Containers C on pallets P are placed on the floor F of a rail car between opposed walls W of the car. Load blocks L are positioned between the containers C and the car walls W to keep the containers from shifting. The blocks are kept in place by means of the skewers S that each have one end inserted into a load block and the other end resting on or supported by an adjacent container C.

As best seen in FIG. 1, the length, width, and height of the load block, indicated by the letters x, y, and z, respectively, are all different. This affords flexibility in the spacing arrangement when loading a rail car or other vehicle.

Figure 3:
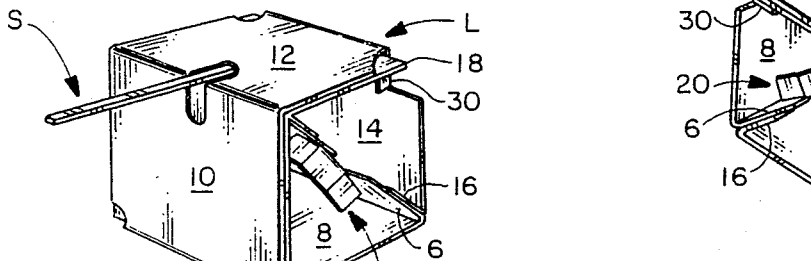
FIGS. 3–5 are views similar to that of FIG. 1, but showing the load block in different positions with a retaining member attached to the load block.
Figure 4:
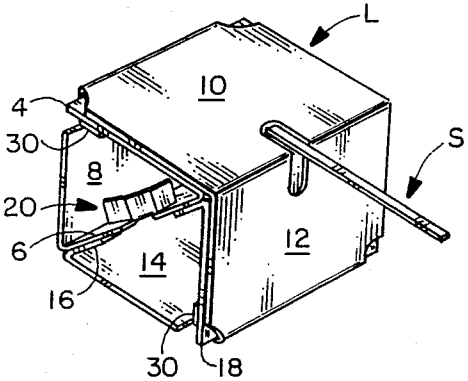
Figure 5:
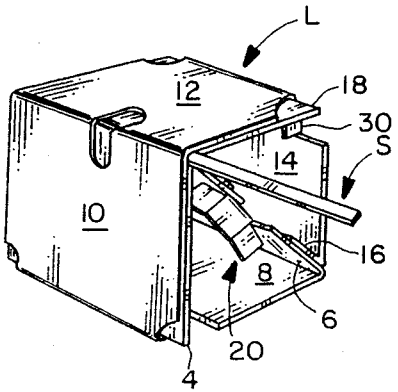

In order to use the block in any one of the three positions to utilize either the length, width, or height of the block, the skewer S can be inserted into opening 29 with the block in either of the positions shown in FIGS. 3 and 4, or it can be inserted into an end of the block at a corner in the space between the adjacent side wall outer panels and the center panels, as shown in FIG. 5.

It will be seen that both of the side wall outer panels have cutouts or recesses 33 at certain corners. The purpose of these is to allow the related side wall inner panels to be pushed inwardly and away from their related outer panels temporarily to make it easier to insert a skewer into an opening of a load block.

Once a skewer is in place the block can be made more secure by bending the retaining tabs 30, which are foldably joined to the singl-ply side walls on fold lines 31, inwardly so their edges abut the inner panels of the adjacent double-ply side walls and retain them against their related outer panels.

Thus, it will be appreciated that the invention provides an efficient and sturdy load block of relatively simple design and construction that is economical to manufacture and very easy to erect by hand.

What is claimed is:

1. A collapsible, self-locking load block for use as dunnage to prevent cargo from shifting in a transportation vehicle, said load block being formed from a unitary blank of foldable sheet material, and comprising:

(a) first, second, third, and fourth side walls operatively joined to each other to form an open-ended, tubular structure that is generally rectangular in cross-section with its width, length, and height of different dimensions;

(b) a pair of center panels foldably joined to certain of said side walls and disposed to extend diagonally between opposite corners of said tubular structure;

(c) said center panels being positioned in face-to-face relation with each other and including integral connecting means providing interlocking engagement therebetween;

(d) said load block presenting a plurality of openings for selectively and alternately receiving a portion of an elongated retaining member to assist in the positioning of said load block adjacent an item of cargo in a transportation vehicle.

2. A load block according to claim 1, wherein certain ones of said side walls have an outer panel and an inner panel disposed in face-to-face relation, and wherein certain others of said side walls have only a single panel.

3. A load block according to claim 2, wherein said outer panels include recesses at certain corners thereof to facilitate the temporary depressing of related inner panels to accomodate the insertion of a retaining member into said load block between said outer and inner panels.

4. A load block according to claim 2, wherein certain of said panels have retaining tabs, cut from material thereof and foldably joined thereto adjacent certain corners thereof, that are adapted to be bent for engagement with adjacent inner panels to maintain said inner panels against their related outer panels.

5. A load block according to claim 1, wherein said connecting means includes at least one lock tab formed from material of and foldably joined to one of said center panels and received within a complementary recess in the other of said center panels.

6. A load block according to claim 5, wherein said at least one lock tab is generally T-shaped and includes a main portion that is foldably joined to the remainder of said one center panel and a pair of wing portions foldably joined to opposite sides of said main portion and adapted to be temporarily deflected to permit insertion of said lock tab into said recess.

7. A collapsible, self-locking load block for use as dunnage to prevent cargo from shifting in a transportation vehicle, said load block being formed from a unitary blank of foldable sheet material, and comprising:

(a) first, second, third, and fourth side walls operatively joined to each other to form an open-ended, tubular structure that is generally rectangular in cross-section with its width, length, and height of different dimensions;

(b) a pair of center panels foldably joined to certain of said side walls and disposed to extend diagonally between opposite corners of said tubular structure in face-to-face relation with each other;

(c) said load block presenting a plurality of openings for selectively and alternately receiving a portion of an elongated retaining member to assist in the positioning of said load block adjacent an item of cargo in a transportation vehicle.

8. A load block according to claim 7, wherein certain ones of said side walls have an outer panel and an inner panel disposed in face-to-face relation, and wherein certain others of said side walls have only a single panel.

9. A load block according to claim 7, wherein said center panels include integral connecting means providing interlocking engagement therebetween.

10. A load block according to claim 8, wherein said outer panels include recesses at certain corners thereof to facilitate the temporary depressing of related inner panels to accomodate the insertion of a retaining member into said load block between said outer and inner panels.

11. A load block according to claim 8, wherein certain of said panels have retaining tabs, cut from material thereof and foldably joined thereto adjacent certain corners thereof, that are adapted to be bent for engagement with adjacent inner panels to maintain said inner panels against their related outer panels.

12. A load block according to claim 7, wherein said connecting means includes at least one lock tab formed from material of and foldably joined to one of said center panels and received within a complementary recess in the other of said center panels.

13. A load block according to claim 12, wherein said at least one lock tab is generally T-shaped and includes a main portion that is foldably joined to the remainder of said one center panel and a pair of wing portions foldably joined to opposite sides of said main portion and adapted to be temporarily deflected to permit insertion of said lock tab into said recess.

14. A unitary blank of foldable sheet material, for use in forming a collapsible, self-locking load block adapted to prevent cargo from shifting in a transportation vehicle, said blank being cut and scored to provide:

(a) the following panels serially arranged and foldably joined to each other along parallel fold lines in the following sequence:
(i) a first side wall inner panel;
(ii) a first center panel;
(iii) a fourth side wall panel;
(iv) a first side wall outer panel;
(v) a second side wall outer panel;
(vi) a third side wall panel;
(vii) a second center panel;
(viii) a second side wall inner panel;

(b) each of said center panels including at one end thereof, a lock tab formed from material of the center panel and foldably joined thereto and adapted to be received within a complementary recess at an opposite end of the other center panel, and each of said center panels having at its opposite end a recess adapted to receive a lock tab of said other center panel when said blank is erected into a load block;

(c) said first and second side wall outer panels having adjacent portions cut out to form a common opening.

15. A blank according to claim 14, wherein said lock tab is generally T-shaped and includes a main portion that is foldably joined to the remainder of the center panel and a pair of wing portions foldably joined to opposite sides of said main portion and adapted to be temporarily deflected to permit insertion of said lock tab into a recess of the other center panel when said blank is erected into a load block.

16. A blank according to claim 14, wherein said side wall outer panels include recesses at certain corners thereof to facilitate the temporary depressing of related side wall inner panels to accomodate the insertion of a retaining member into said load block between said side wall outer and inner panels when said blank is erected into a load block.

17. A blank according to claim 14, wherein certain of said side wall panels have retaining tabs, cut from material thereof and foldably joined thereto adjacent certain corners thereof, that are adapted to be bent for engagement with adjacent side wall panels to maintain said side wall inner panels against their related side wall outer panels when said blank is erected into a load block.

* * * * *